United States Patent [19]

Van Parys

[11] 4,189,174

[45] Feb. 19, 1980

[54] CLOSING DEVICE FOR SLIDING DOORS AND WINDOWS

[76] Inventor: Remi E. Van Parys, 80, Zultseweg, Waregem, Belgium

[21] Appl. No.: 889,521

[22] Filed: Mar. 23, 1978

[30] Foreign Application Priority Data

Apr. 4, 1977 [BE] Belgium ..... 116394

[51] Int. Cl.[2] ..... E05C 19/10

[52] U.S. Cl. ..... 292/98; 70/99

[58] Field of Search ..... 292/56, 98, 101, 107, 292/DIG. 46, 204, 197, 224, 245, 140, 222, 111, 27; 70/95, 99

[56] References Cited

U.S. PATENT DOCUMENTS

| | | | |
|---|---|---|---|
| 966,865 | 8/1910 | Schuyler | 292/204 X |
| 2,405,240 | 8/1946 | Sherer et al. | 292/98 X |
| 2,810,284 | 10/1957 | Wartian | 70/99 |
| 2,983,000 | 5/1961 | Metzger | 292/98 X |
| 3,044,287 | 7/1962 | Pelcin | 70/99 |
| 3,065,985 | 11/1962 | Du Four | 292/204 X |
| 3,161,923 | 12/1964 | Crain | 292/DIG. 46 X |
| 3,563,068 | 2/1971 | Dushane | 292/98 X |
| 3,893,261 | 7/1975 | Cribben | 292/DIG. 46 X |
| 4,024,739 | 5/1977 | Kaufman | 292/DIG. 46 X |
| 4,068,874 | 1/1978 | Fleming et al. | 292/DIG. 46 X |

FOREIGN PATENT DOCUMENTS

| | | | |
|---|---|---|---|
| 224763 | 1/1959 | Australia | 292/DIG. 46 |
| 554012 | 3/1958 | Canada | 292/DIG. 46 |
| 1396876 | 6/1975 | United Kingdom | 292/DIG. 46 |

*Primary Examiner*—J. Franklin Foss

*Attorney, Agent, or Firm*—Kenyon & Kenyon

[57] ABSTRACT

There is described a closing device which comprises a cylinder lock, a worm which is connected to the rotating lock core in such a way that said worm rotates together with said core, and a pin which enters the worm groove, whereby one of those elements formed by the worm and the pin is movable in the direction of the lock core rotation axis relative to said core, said movable element cooperating with the lever to cause said lever to swing with the movement thereof in the core lengthwise direction caused by the worm rotation.

28 Claims, 5 Drawing Figures

CLOSING DEVICE FOR SLIDING DOORS AND WINDOWS

This invention relates to a closing device for sliding doors and windows, which device comprises a support to be fastened on one of those parts formed respectively by the sliding leaf and the fixed upright of a sliding door or window, and a lever swingably mounted on said support, the one end of said lever being provided with a projection acting as bolt and cooperating with a rim which is mounted on the other one of said parts of the sliding door or window, and which can fit behind said rim in one lever position, namely the closing position thereof.

With closing devices of this kind no use has been made up to now of locks to open or close the device.

There are actually known closing devices where such locks and more particularly cylinder locks are used but the devices are of the so-called built-in type which are built mainly in a vertical fixed upright or a vertical upright of the sliding leaf and which comprise a hook-like bolt projecting outside the upright. The cylinder lock used with said closing devices is provided with a core which cooperates with a sidewards projection which then operates the bolt. The cylinder slot core axis should be directed horizontally and at right angle to the sliding leaf plane as the bolt which has then to be of hook shape, should be moved in parallel relationship with the sliding leaf plane.

In closing devices that comprise a lever which is mounted on the outer side of the sliding leaf, on the fixed upright, the lever hinging axis does not run precisely at right angle to the sliding leaf plane. There are such closing devices in which the lever is a profile section which is rotatable about a vertical axis on the support which is also comprised of a profile section. There are also known closing devices with levers whereby the lever is mounted inside a recess in an upright, and the lever is rotatable about a horizontal axis running parallel to the sliding leaf plane. In both kinds of closing devices the lever is provided with a projection which has to hook behind a rim which is directed at right angle to the sliding leaf plane or which has to be thrust into a cut-out with a movement substantially at right angle to said plane. Cylinder locks the core of which is connected to a sidewards projection cannot be used with this kind of closing devices.

The invention has for object to provide a closing device of the above-defined type the lever of which is nonetheless operated by a lock device.

For this purpose the closing device comprises a cylinder lock, a worm which is connected to the rotating lock core in such a way that said worm rotates together with said core, and a pin which enters the worm groove, whereby one of those elements formed by the worm and the pin is movable in the direction of the lock core rotation axis relaive to said core, said movable element cooperating with the lever to cause said lever to swing with the movement thereof in the core lengthwise direction caused by the worm rotation.

In a particular embodiment of the invention, the pin lies on that lever end which is opposite the end provided with a projection, while the worm is substantially positively connected to the lock core.

This embodiment is mostly usable with that closing device type where the lever is rotatable about a horizontal axis in parallel relationship with the sliding leaf.

In another embodiment of the invention, to the contrary, the pin is fixed relative to that door or window portion wherein the lock is mounted but the worm is movable along the core lengthwise direction relative to said core and the worm proper cooperates with the lever.

Such an embodiment is mostly suitable for closing devices of that type whereby the lever is comprised of a substantially L-shaped section which adjacent the flange junction thereof is hingedly fastened about a vertical axis to the support which is also comprised of a profile section.

Preferably the worm is provided on the side thereof removed from the core, with a head which enters with one side a channel formed by the lever.

In a preferred embodiment of the invention, the worm is provided on the outer periphery thereof with at least one groove running along the lengthwise direction thereof, said groove thus crossing the groove of the worm proper in such a way that the pin as it lies at the crossing between the straight groove and the screw-like groove of the worm porper, can perform a relative alternating motion in the lengthwise direction of the lock core, relative to the worm, thereby the length of the straight groove is such that the lever is then swingable between completely open and completely closed positions.

When the cylinder lock core thus so lies that the straight groove faces the pin, the lever can thus be operated independently of the lock, for example by hand.

The invention further relates to a closing device of the above-defined kind whereby moreover that projection side which engages the rim when closing the door or window, is so bevelled that when the door or window is slid closed, the projection as it engages said rim is pushed away by the rim and thus swings at least temporarily the lever to the open position.

Known closing devices of this kind comprise a spring element which is mounted between the lever and the support thereof and which always returns the lever to the closed position. When sliding the door or window closed, the lever projection is somewhat raised by the rim against the action of said spring, after which the projection hooks directly behind the rim. The door or window is thus automatically closed. In many cases, mostly with windows, it is only possible to swing the lever against the spring action but from the inside, to the unclosed or open position. When someone is in such a case on the outer side of the door or window and when this door or window is closed for instance by mistake, it is no more possible to open the door or window. There are actually hook locks the hook of which is pushed in when it engages a fixed part. One has to raise the hook by means of a lever to hook same over a rim to close the door or window. Such locks are of the so-called non-automatic type. The large drawback of such locks is however that they have to be mounted in an upright either of the fixed frame or of the sliding leaf. The mounting of such locks is consequently relatively complex and moreover one upright is weakened. Generally the operating mechanism to bring such locks to the open or closed position is not pleasing to the eye.

The invention has now for object to provide a closing device for sliding doors and windows, which is still of that kind which is comprised of a support to be mounted on the fixed frame or the sliding leaf and a lever which is mounted on said support, which is simple to locate and which can be made pleasant to the eye, for instance in the shape of a handle, and which does not however close automatically, for example due to an unintentional sliding closed.

For this purpose, the closing device comprises at least one pawl mechanism the pawl-forming member of which is mounted on one of the elements formed respectively by the lever and the fixed support thereof, while at least one raised portion cooperating with said pawl-forming member is provided on the other part, in such a way that when the lever is swung to the open position, the pawl-forming member engages in working but breakable cooperation with the raised portion, whereby the pawl mechanism retains the lever in such open position as long as no action is induced from the outside on said mechanism.

When the sliding door or window is simply slid closed, the lever is automatically brought to the open position if it does not already lie in such position. The lever does not go automatically to the closed position but rather some power, namely to release the pawl-forming member from the raised portion, is required to bring the lever to the closed position.

In another embodiment of the invention, at least one of those elements formed by the pawl-forming member and the raised portion is resiliently movable relative to the closing device part it is mounted on.

Preferably the pawl-forming member is resiliently movable relative to that closing device part it is mounted on.

Usefully the pawl mechanism then comprises a pawl which movably enters an opening which is provided in one of those parts formed respectively by the lever and the fixed support thereof and means to push the pawl resiliently out of the opening, while the other part is provided with at least one recess cooperating with the pawl, said pawl entering partly said recess in the open position of the lever.

In a particular embodiment of the invention, the pawl-forming member is mounted on the support and the raised portion is provided on part of the lever.

In a remarkable embodiment of the invention, the lever has a knob-forming portion and one of those elements formed by the pawl-forming member and the raised portion, is provided on said knob-forming portion.

In an advantgeous embodiment of the invention, the support for the lever is formed by a profile section while the lever also is formed by a profile section which comprises essentially two flanges enclosing an angle, while the lever projection is formed by a rim of said latter profile section.

In an useful embodiment of the invention, that part provided with the raised portion among those parts formed by the lever and the support thereof, is provided twice with a raised portion cooperating with the pawl-forming member on the other part, in such a way that the lever can be retained not only in the closed position but also in the open position by the cooperating of the member and one of the raised portions.

In a preferred embodiment of the invention, the closing device also comprises a cylinder lock and a worm which is connected to the rotatable core of the lock, the worm being provided besides the helix-like groove, also with a groove running in the lengthwise direction thereof, and a pin which enters at will one of the grooves, whereby one of those elements formed by the worm and the pin is movable along the direction of the rotation axis of the lock core relative to the core, the movable element cooperating with the lever to cause the lever to swing due to the movement thereof along the core lengthwise direction.

It is thus possible to combine the first-mentioned advantages regarding the use of the lock with the advantages regarding the non-automatic closing of the closing devices.

Other details and features of the invention will stand out from the following description given below by way of non limitative example and with reference to the accompanying drawings, in which.

In the various figures the same reference numerals pertain to similar elements.

The closing device as shown in the figures is mounted on the inner side of a sliding panel, such as door or window, on the vertical upright 1 thereof. This device is comprised mainly of a lever 2, and a support 3 for the lever 2. The support 3 is fastened by means of screws 4 to the upright 1.

Figure 1:
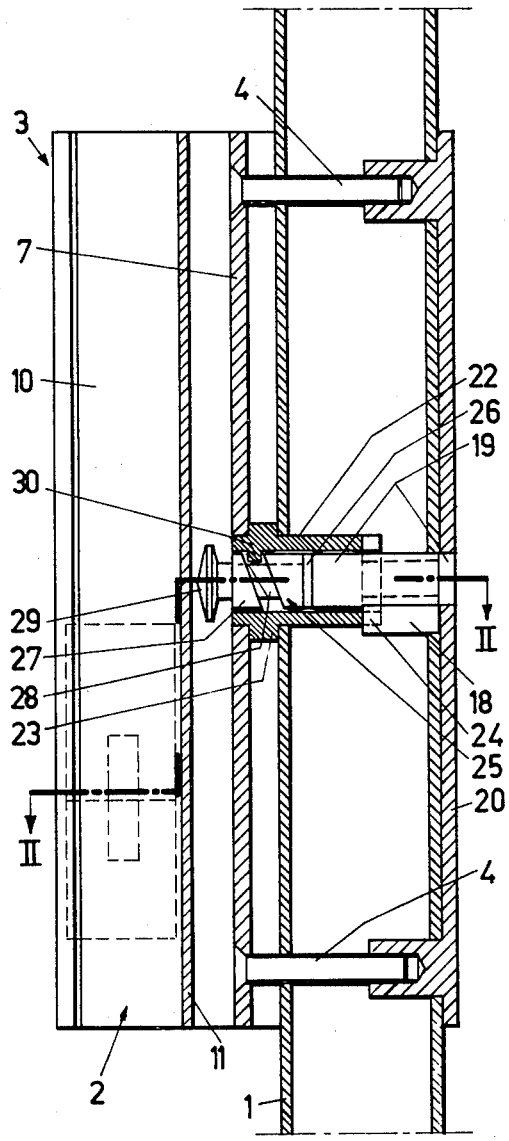
FIG. 1 is a vertical cross-section through a closing device according to the invention, as mounted on a sliding door or window.
Figure 2:
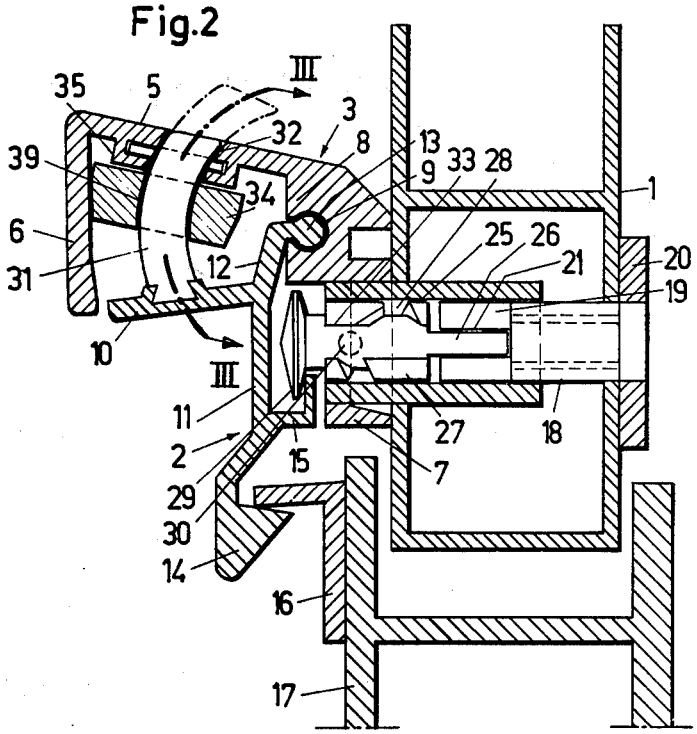
FIG. 2 shows a cross-section along line II—II in FIG. 1, but drawn on a larger scale.
Figure 3:
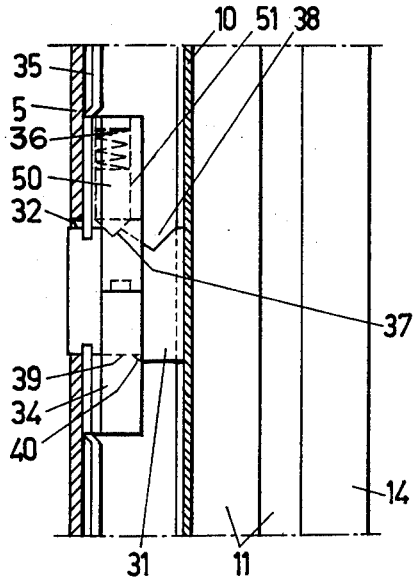
FIG. 3 shows a cross-section along line III—III in FIG. 2 but drawn on the same scale as FIG. 1.

In the embodiment as shown in FIGS. 1 to 3, the support 3 is comprised of a profile section which is substantially of U-shape. THis U-shaped profile section is thus comprised of a bottom 5 and two flanges 6 and 7 running parallel to one another. The bottom 5 lies at an angle to the flanges 6, 7 and flange 7 is substantially higher than flange 6. The support 3 is fastened with the long flange 7 thereof against upright 1. At the junction of flange 7 with bottom 5, the profile section forming support 3 is further provided over the whole length thereof with an overthickness 8 wherein a groove 9 is cut-out.

The lever 2 is also a profile section which is essentially of U-shape (FIG. 2). This lever 2 thus comprises two flanges 10 and 11 which enclose an angle smaller than 90°. The lever 2 also has an extension 12 which extends from the flange 11 on the side of the flange 10 and carries, at the free end, an extension 12 which bears at the free end thereof, an overthickness 13 which fits in the groove 9 of the support 3. Both the groove 9 and the overthickness 13 have a cross-section which is slightly larger than a half circle, in such a way thus that the over-thickness 13 cannot come out sidewise from the groove 9, but can only be slipped endwise in the groove 9. In this way, the lever 2 is hingedly fastened about a vertical axis to the support 3. A hook-shaped rim 14 is also connected to the opposite end of the flange 11. This rim 14 also extends over the whole length of the profile section forming the lever 2. A hook-forming rim 15 also extends from the flange 11 between the rim 14 and flange 10, on that side removed from the flange 10. An end part (not shown) can also be arranged at both ends of the fixed profile section which forms the support 3 to prevent the profile section forming lever 2 from sliding in the lengthwise direction thereof. To make things clearer, the end parts are not shown in the figures.

The hook-forming rim 14 of lever 2 is designed to cooperate with a rim 16 which is mounted on an upright 17 of the fixed frame of the sliding door or window. To simplify the showing the upright 17 and rim 16 are shown but in FIG. 2. The length of rim 16 which also extends vertically, is the same as the length of lever 2.

When the door or window is slid shut and the lever 2 lies in the closed position, the rim 14 then hooks behind the rim 16. The flange 11 of lever 2 then extends substantially in parallel relationship with flange 7 of the support 3 while that end of flange 11 removed from flange 10 comes substantially opposite the free end of flange 6 of the support 3. The closing device has been shown in such a position in the figures. The rim 15 is then still some 1.5 mm away from flange 7 of the support 3.

Before the opening of the closing device, the flange 10 of the lever can be swung towards the bottom 5 of support 3 in such a way that the rim 14 is thus raised and the rim 16 can pass below same.

The opening and closing of the closing device can be performed in various ways.

A first way is by means of a cylinder lock which is comprised of a fixed part 18 and a rotatable core 19. The cylinder lock 18, 19 is of known construction and will not be described in detail hereinafter. The lock is actually of that type whereby the core 19 is rotatable over 360° in the fixed part by means of the suitable key. The fixed part 18 is provided as usual with a key bit wherein are mounted the pins. The key bit enters a suitable cut-out in the upright 1 on which the cylinder lock is so mounted as to prevent the fixed part 18 rotating. The lock 18 from, 19 is so mounted in upright 1 that the opening for the key hole lies on the outer side of upright 1. A lock plate 20 is also arranged around the end of the lock 18, 19 which projects on the outer side of the upright 1. This lock plate goes through the wall of upright 1 with two projections and is fastened to the outer side of upright 1 by means of the screws 4 which fasten the flange 7 of support 3 to upright 1. The screws 4 are screwed with the end thereof in the projections.

The core 19 extends in the cross-wise direction, that is at a right angle to the plane of the sliding leaf. The core 19 is provided on that side thereof removed from the key hole, with a relatively deep slot 21.

That end of core 19 provided with a slot is rotatingly arranged inside casing 22. The casing 22 is provided with a flange 23 which is fastened to that side facing inwards of upright 1. A small portion of casing 22 projects outside upright 1. The major portion thereof lies inside the upright 1. It is in the latter portion that the end of core 19 fits. The latter portion is also provided at the end thereof with a slot 24 wherein the key bit of the fixed part 18 of the cylinder lock 18, 19 fits in such a way that the casing 22 also contributes to retain the fixed part 18.

The closing device comprises a worm which is shown generally in 25 in the figures. The worm is comprised of a flat end 26 which slidingly fits in the slot 21 of core 19, a round body 27 which is provided with a helix-shaped groove 28 which extends over precisely one complete winding, and a mushroom-shaped head 29 connecting thereto the stem of which has a diameter which is smaller than the diameter of body 27 but the head proper has a diameter which is larger than the diameter of body 27.

On the inner side of casing 22 lies a small pin 30 which enters the groove 28. As the casing 22 and the lock 18, 19 are fixed relative to the upright 1, when the core 19 is rotated, the groove 28 will move over the pin 30 and consequently the worm 25 will move alternately in the lengthwise direction or along the rotation axis of the core 19. The end 26 then slides inside slot 21.

The head 29 of the worm 25 grips behind the rim 15 and thus enters with a portion thereof in the channel formed by the rim 15 and the flange 11 of lever 2. Due to said alternating motion of worm 25, the lever 2 will thus be swung from the closed to the open position and back from the open to the closed position. All this is so designed that starting from a position of the core 19 which the key can be thrust in the key hold or can be removed therefrom, the core 19 can be rotated over 360°, in the one direction and in the opposite direction, so that the lever 2 swings between both end positions thereof, respectively the open and closed positions.

A second way to open and close the closing device lies in operating the lever 2 by hand, either by pushing directly on the flange 10 when opening, or on the flange 11 when closing, of the lever 2, or by pushing but however before the closing, a knob 31 which is made positively fast to that side of flange 11 which is removed from flange 10. The knob 31 passes through an opening 32 in the bottom 5 of support 3 (FIG. 2).

To also allow such a hand-operated swinging of lever 2, the worm 25 is further provided with a straight groove 33 which runs over the whole worm body and opens on the outer circumference thereof. The groove 33 thus crosses the helix-shaped groove 28 and has the same width and depth as the groove 28. The groove 33 runs from the start of the screw-like winding along which runs the groove 28 up to the end of winding. The pin 30 which stands on the casing 22 can also move inside the groove 33. When the cylinder lock 18, 19 lies in a position whereby the key can be thrust therein or can be removed therefrom, that is when the core 19 has been rotated until the closing device is completely open or completely shut, the groove 33 faces the pin 30. The lever 2 may then be swung alternately between the open and closed positioned thereof. The worm 25 moves thereby alternately relative to the core 19. Both when the lever 2 lies in the completely open position thereof and when it lies in the completely closed position, the pin 30 lies opposite one end of helix-shaped groove 28. It is thus always possible after the complete opening or closing by hand of the closing device, to cause the worm 25 to swing by means of the cylinder lock 18, 19 in such a way that in the end positions of lever 2, it is possible to switch at will from the hand operation to the operation with the cylinder lock 18, 19.

The knob 31 cooperates with a small pawl 50 (FIG. 3) which movably fits in a cylinder-shaped opening 51 which is provided into an auxiliary part 34 which is made fast to the inner side of the bottom 5 of support 3. This auxiliary part 34 is comprised of two discrete pieces to make the mounting easier. The one piece of auxiliary part 34 lies for instance inside two grooves facing one another, which grooves are formed by small ribs 35 which stand on the inner side of bottom 5. On either side of the latter piece, the ribs are provided with an indenting in such a way that the auxiliary part 34 cannot slide relative to bottom 5. The pawl 50 is pushed out of opening 51 against the one side of knob 31 by means of a spiral spring 36 which is also arranged inside said opening 51. The pawl 50 is shaped as a small cylinder the one end of which is bevelled in the shape of a cap.

This bevelled end of pawl 50 fits inside two triangular cut-outs 37 and 38 which are provided in the side of the knob 31. The cut-out 37 is so provided in said side that the pawl 50 enters same when lever 2 lies in the closed position. The cut-out 38 is substantially deeper and it is so located in the side of the knob 31 that the pawl 50 enters same when the lever 2 lies in the open position. The knob 31 extends cross-wise through the auxiliary part 34 which is thus provided with an opening 39 into which the opening 51 housing the pawl 50 opens. The opening 39 has a width which is equal to the thickness of knob 31 but a length which is somewhat larger than the width of said knob 31.

While in the one side extending along the thickness and width direction are provided the cut-outs 37 and 38, the opposite side of the knob 31 is provided approximately facing that portion of the first side lying between the cut-outs 37 and 38, with a small step 40 with a slanting of 45° which rises in the direction of that knob end nearest the cut-out 38. As due to the spring 36 and the pawl 50, the knob 31 is always pushed with the side provided with the step 40 against the edge of the opening 34 in the auxiliary part 34, when the knob 31 is pushed out of support 3, which thus occurs as the lever 2 swings to the open position. The knob will at some particular moment slide towards that side of the auxiliary part 34 on which the pawl 50 is present, whereby the pawl 50 will be pushed somewhat deeper in the opening 51 by the action of spring 36.

Due to the presence of the knob 31 cooperating with the pawl 50 the lever 2 lies in a quite stable condition in the closed position and mostly in the open position. To move the lever 2 from such positions, some force has to be exerted on the lever, possibly through knob 31, as the pawl 50 has to be pushed out of the cut-outs 37 or 38.

Thus, when the lever is brought unintentionally to the open position, it will not return automatically to the closed position but will rather be locked in the open position until someone brings the lever to the closing position either by hand or by means of the cylinder lock 18, 19. That side of the rim 14 of lever 2 facing the fixed upright 17 of the rim 14 is so bevelled that when the sliding leaf is slid shut and in the closed position of lever 2, the rim 14 engages the fixed rim 16 and is raised so that the lever 2 will swing to the open position. An unintentional closing of the closing device thus cannot occur. Such closing may only occur purposefully by operating the lever 2 by hand from the inside, or by closing the cylinder lock 18, 19 by means of a key from the outside. In FIGS. 2 and 3, the lever and the knob 31 have been shown in the closed position. The position of knob 31 when the closing device is open has been shown in dotted lines.

Figure 4:
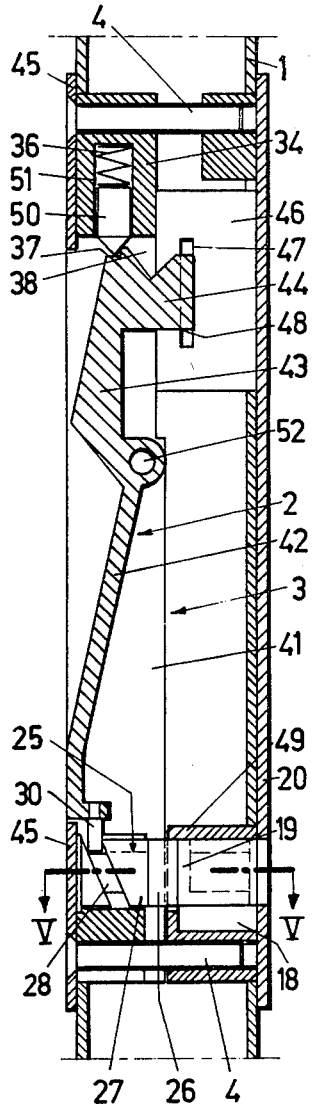
FIG. 4 shows a vertical cross-section similar to FIG. 1 but pertaining to another embodiment of the closing device according to the invention.
Figure 5:
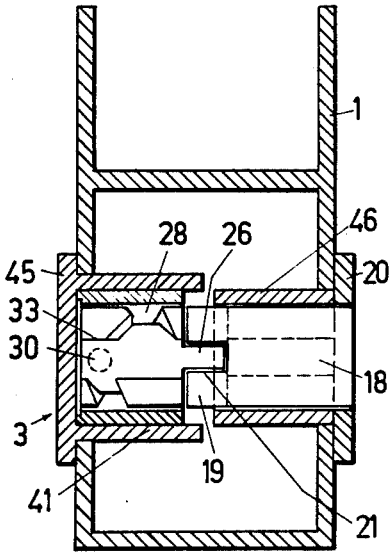
FIG. 5 shows a cross-section along line V—V in FIG. 4 but drawn on a larger scale.

In the embodiment as shown in FIGS. 4 and 5, the support 3 is formed by an elongated bottomless pan 41 which is imbedded in upright 1. The pan 41 is provided with rims 45 which are fastened by means of screws 4 to the inner side of the sliding door or window, on said upright 1. The lever 2 is not a profile section but is rather comprised of two arms, namely a relatively long operating arm 42 and a shorter working arm 43 lying substantially in the extension thereof. The working arm 43 is provided at the end thereof with a projection 44 which forms a lock bolt. Between both arms 42 and 43, the lever 2 hinges about a horizontal axis 52 which runs in parallel relationship with the sliding leaf plane between both lengthwise walls of the pan 41. The cross-wise side of upright 1 which faces the fixed upright 17, is provided with an opening 46 opposite bolt 44. Opposite the opening on the fixed upright 17 lies a small plate 47 extending in the plane of the sliding leaf, the plate 47 being provided with an opening 48 for the projection 44. When sliding shut the leaf, the plate 47 goes through opening 46 in upright 1. That side facing the plate 47 of the projection 44 is so bevelled that the lever 2 is caused to swing by the engagement of the bevelled side and the small plate 47. With a further sliding, when the leaf is completely shut, the bolt-forming projection 44 faces the opening 48 in such a way that by swinging the lever 2 anew, the bolt enters the opening. A portion of the small plate then forms a rim behind which hooks the bolt to prevent sliding the leaf open.

As mentioned above the lever 2 swings automatically open by the sliding shut. The lever 2 does not however swing automatically closed. Such shut-swinging can occur by hand in the same way as in the embodiment according to figures 1 to 3, while both the open and shut swinging of lever 2 can also occur by means of a cylinder lock 18, 19. The cylinder lock 18, 19 is identical with the cylinder lock used in the embodiment according to FIGS. 1 to 3. The cylinder lock wherein a key can be thrust from the outer side of upright 1, is retained in position by means of a bushing 49 fixedly mounted in the profile section 1 whereby the fixed part 18 is prevented from swinging by the bushing 49. In this embodiment also a worm 25 is connected for the core 19 but the worm 25 has no head 29. But to this difference, the worm 25 is identical with the worm used in the embodiment according to FIGS. 1 to 3. Where in the latter embodiment the worm 25 is movable relative to core 19 but the pin 30 which enters groove 28 of the worm is fixed relative to upright 1, in the embodiment as shown in FIGS. 4 and 5, the worm 25 is not movable along the lengthwise direction of core 19 but to the contrary the pin is directly mounted on lever 2 and consequently movable therewith. The worm 25 always lies between core 19 on the one hand and a rim 45 of pan 41 on the other hand whereby the flat end 26 always lies completely inside slot 21 of core 19. It is clear that by the rotation of core 19, the lever 2 will be swung according to the rotation direction of core 19 towards the closed position or the open position. In the rest position of core 19 whereby thus the key can be removed from lock 18, 18 or thrust therein, the pins also lies in the straight groove 33 in such a way that in this position also the lever 2 can be swung. Such swinging can then occur as mentioned above by the sliding shut of the leaf or by hand by pushing directly on one of the arms 42 or 43.

In the embodiment as shown in FIGS. 4 and 5, the lever 2 is not provided with a knob to swing same bu the cut-outs 37 and 38 which are provided in the embodiment according to FIGS. 1 to 3 in knob 31, are provided in the projection 44 proper in the embodiment according to figures 4 and 5. The cut-out 37 is not however of triangular shape but it is rather comprised of a cut-off corner of projection 44. This projection 44 also cooperates with that side thereof provided with the cut-outs 37 and 38, with a pawl 50 which lies together with a spring 36 inside opening 51. This opening 51 is also provided in an auxiliary part 34 which is made fast in pan 41.

The working both of the combination of cylinder lock 18, 19 and worm 25, and of the combination of cut-outs 37-38 in lever 2 and pawl 50 is the same as in the embodiment as shown in FIGS. 1 to 3. The lever 2 thus remains relatively stable both in the closed position and in the open position. By the sliding shut of the leaf, the lever is automatically pushed to the open position and some force is required to bring the lever from such open position to the closed position. When the closing device is open, it can be closed by means of the cylinder lock 18, 19 and when the closing device is shut, it can be opened by means of the cylinder lock.

The invention is in no way limited to the above embodiments and many changes can be brought therein without departing from the scope of the invention as defined by the appended claims.

For instance use should not necessarily be made for the stop with which the lever cooperates to retain same somewhat in the open position, of a resiliently-mounted pawl. It is not necessary either that the pawl be fixed relative to the upright while the lever is provided with cut-outs. The reverse arrangement is also possible.

In the embodiment as shown in FIGS. 1 to 3, it is not necessary either that the cylinder lock slot be provided with a slot and the worm with a flat portion fitting therein. The core can also have a flat portion while the slot is provided in the worm, or the flat portion can be a completely loose part which fits into slots both in the core and the worm.

I claim:

1. Closing device for sliding doors and windows, having a support to be fastened on one of those parts formed respectively by the sliding leaf and the fixed upright of a sliding door or window, and a lever swingably mounted on said support, the one end of said lever being provided with a projection acting as bolt and cooperating with a rim which is mounted on the other one of said parts of the sliding door or window, and which can fit behind said rim in one lever position, namely the closing position thereof, which comprises a cylinder lock, a worm which is connected to the rotating lock core in such a way that said worm rotates together with said core, and a pin which enters the groove, whereby one of those elements formed by the worm and the pin is movable in the direction of the lock core rotation axis relative to said core, said movable element cooperating with the lever to cause said lever to swing with the movement thereof in the core lengthwise direction caused by the worm rotation.

2. Device as defined in claim 1, in which the pin lies on that lever end which is opposite the end provided with a projection, while the worm is substantially positively connected to the lock core.

3. Device as defined in claim 1, in which the pin is fixed relative to that door or window portion wherein the lock is mounted but the worm is movable along the core lengthwise direction relative to said core and the worm proper cooperates with the lever.

4. Device as defined in claim 3, in which the worm is provided on the side thereof removed from the core, with a head which enters with one side a channel formed by the lever.

5. Device as defined in claim 3, in which one of those parts formed by the cylinder lock core and the worm, has a flat end which fits slidingly in a slot of the other part.

6. Device as defined in claim 1, in which the cylinder lock is of that type where the core is rotatable over 360°.

7. Device as defined in claim 1, in which the hexli-shaped groove of the worm forms precisely a complete winding.

8. Device as defined in claim 1, in which the worm is provided on the outer periphery thereof with at least one groove running along the lengthwise direction thereof, said groove thus crossing the groove of the worm proper in such a way that the pin as it lies at the crossing between the straight groove and the screw-like groove of the worm proper, can perform a relative alternating motion in the lengthwise direction of the lock core, relative to the worm, whereby the length of the straight groove is such that the lever is then swingable between completely open and completely closed positions.

9. Device as defined in claim 8, in which the straight groove runs between the start and the end of the worm helix groove.

10. Device as defined in claim 6, in which the worm is provided with a groove running along the lengthwise direction thereof, in which the pin cooperating therewith fits in the rest position of the cylinder lock core.

11. Device as defined in claim 1 which comprises both a cylinder lock with a worm and a pawl mechanism with a pawl-forming member and a raised portion.

12. Closing device for sliding doors and windows, having a support to be fastened on one of those parts formed respectively by the sliding leaf and the fixed upright of a sliding door or window, and a lever swingably mounted on said support, the one end of said lever being provided with a projection acting as bolt and cooperating with a rim which is mounted on the other one of said parts of the sliding door or window, and which can fit behind said rim in one lever position, namely the closing position thereof, whereby that side of the projection engaging the rim by the closing of the door or window, is so bevelled that by the sliding shut of said door or window, the projection as it engages the rim ispushed away thereby and thus causes at least temporarily the lever to swing to the open position, which device further comprises at least one pawl mechanism the pawl-forming member of which is mounted on one of the elements formed respectively by the lever and the fixed support thereof, while at least one raised portion cooperating with said pawl-forming member is provided on the other part, in such a way that when the lever is swung to the open position, the pawl-forming member engages in working but breakable cooperation with the raised portion, whereby the pawl mechanism retains the lever in such open position as long as no action is induced from the outside on said mechanism; and further having a cylinder lock with a worm.

13. Device as defined in claim 12, in which at least one of those elements formed by the pawl-forming member and the raised portion is resiliently movable relative to that closing device part it is mounted on.

14. Device as defined in claim 13, in which the pawl-forming member is resiliently movable relative to that closing device part it is mounted on.

15. Device as defined in claim 14, in which the pawl mechanism comprises a pawl which movably enters an opening which is provided in one of those parts formed respectively by the lever and the fixed support thereof and means to push the pawl resiliently out of the opening, while the other part is provided with at least one recess cooperating with the pawl, said pawl entering partly said recess in the open position of the lever.

16. Device as defined in claim 12, in which the pawl-forming member is mounted on the support and the raised portion is provided on part of the lever.

17. Device as defined in claim 12, in which that element among those elements formed by the pawl-like member and the raised portion, which lies on the lever is provided on the lever projection.

18. Device as defined in claim 12, in which the support for the lever is formed by a profile section while the lever also is formed by a profile section which comprises essentially two flanges enclosing an angle, while the lever projection is formed by a rim of said latter profile section.

19. Device as defined in claim 12, in which that part provided with the raised portion among those parts formed by the lever and the support thereof, is provided twice with a raised portion cooperating with the pawl-forming member on the other part, in such a way that the lever can be retained not only in the closed position but also in the open position by the cooperating of the member and one of the raised portions.

20. Device as defined in claim 17, in which the lever is comprised of two arms and the raised portion is provided on the projection on the one arm.

21. Device as defined in claim 18, in which the rimmed flange in the completely closed position of the lever lies, but in the location of hinging axis thereof, at a distance from the lever support which is at least equal to 1 mm.

22. Closing device for sliding doors and windows, having a support to be fastened to one of those parts formed respectively by the sliding leaf and the fixed upright of a sliding door or window, and a lever swingably mounted on said support, the one end of said lever being provided with a projection acting as bolt and cooperating with a rim which is mounted on the other one of said parts of the sliding door or window, and which can fit behind said rim in one lever position, namely the closing position thereof, which comprises a cylinder lock, a worm which is connected to the rotating lock core in such a way that said worm rotates together with said core, and a pin which enters the groove, whereby one of those elements formed by the worm and the pin is movable in the direction of the lock core rotation axis relative to said core, said movable element cooperating with the lever to cause said lever to swing with the movement thereof in the core lengthwise direction caused by the worm rotation;

and in which the lever has a knob-forming portion and one of those elements formed by the pawl-forming member and the raised portion, is provided on said knob-forming portion, said knob-forming portion passing through an opening in the support for the lever and said portion is provided besides the raised portion cooperating with the pawl-forming member, with a small step which slants away in the movement direction of the portion by the swinging shut of the lever, said step cooperating with an edge of said opening.

23. Device as defined in claim 22, in which said raised portion in the knob-forming portion is formed by a cut-out which is provided in a side edge of said portion and the small step is provided in said first-mentioned horizontal side edge of said portion.

24. Closing device for sliding doors and windows, having a support to be fastened on one of those parts formed respectively by the sliding leaf and the fixed upright of a sliding door or window, and a lever swingably mounted on said support, the one end of said lever being provided with a projection acting as bolt and cooperating with a rim which is mounted on the other one of said parts of the sliding door or window, and which can fit behind said rim in one lever position, namely the closing position thereof, whereby that side of the projection engaging the rim by the closing of the door or window, is so bevelled that by the sliding shut of said door or window, the projection as it engages the rim is pushed away thereby and thus causes at least temporarily the lever to swing to the open position, which device further comprises at least one pawl mechanism the pawl-forming member of which is mounted on one of the elements formed respectively by the lever and the fixed support thereof, while at least one raised portion cooperating with said pawl-forming member is provided on the other part, in such a way that when the when the lever is swung to the open position, the pawl-forming member engages in working but breakable cooperation with the raised portion, whereby the pawl mechanism retains the lever in such open position as long as no action is induced from the outside on said mechanism, and in which the support for the lever is formed by a profile section while the lever also is formed by a profile section which comprises essentially two flanges enclosing an angle, while the lever projection is formed by a rim of said latter profile section; and in which said knob-forming lever portion is made positively fast on that side removed from the rimmed flange of the other flange, said knob-forming portion going through an opening in the support and being provided with the raised portion cooperating with the pawl-forming member.

25. In combination with a sliding glass panel, a closing device comprising a support secured to said panel;

a lever pivotally mounted on said support for movement between a closed position and an open position, said lever having a projection at one end for engaging over a rim of a fixed frame and a hook-framing rim defining a channel; and a cylinder lock mounted in said panel, said lock including a rotatable core mounted in said panel for rotation with a key, a worm having one end axially sliding and rotatably mounted in said core, a body about said worm having a helix-shaped groove and a straight groove in crossing relation to said helix-shaped groove, a pin secured to said panel and disposed in at least one of said grooves, and a head on said worm disposed in said channel of said lever for engaging said hook-forming rim whereby in said closed position, said lever is capable of manual pivoting to said open position while sliding said worm outwardly of said core with said pin in said straight groove and said core is capable of rotation via a key to rotate said core with said pin in said helix-shaped groove to pivot said lever to said open position.

26. The combination as set forth in claim 25 which further comprises a pawl mechanism for holding said lever in a respective one of said closed and open positions.

27. In combination with a sliding glass panel, a closing device comprising a pivotally mounted lever for movement between a closed position and an open position, said lever having a projection at one end for engaging in a frame and a pin at an opposite end; and a cylinder lock mounted in said panel, said lock including a rotatable core mounted in said panel for rotation with a key, and a worm mounted on said core with a helix-shaped groove and a straight groove in crossing relation to said helix-shaped groove therein, at least one of said grooves receiving said pin therein whereby in said closed position, said lever is capable of manual pivoting while said pin slides in said straight groove and said core is capable of rotation via a key to pivot said lever to said closed position while said pin slides in said helix-shaped groove.

28. The combination as set forth in claim 27 which further comprises a pawl mechanism for holding said lever in a respective one of said closed and open positions.

* * * * *

UNITED STATES PATENT AND TRADEMARK OFFICE

CERTIFICATE OF CORRECTION

PATENT NO. : 4,189,174

DATED : February 19, 1980

INVENTOR(S) : REMI EMIEL VAN PARYS

It is certified that error appears in the above—identified patent and that said Letters Patent is hereby corrected as shown below:

Column 1, line 58, change "relaive" to --relative--
Column 2, line 24, change "thereby" to --whereby--
Column 3, line 27, change "the" to --that--
Column 4, line 28, after "as" insert --a--
Column 4, line 35, change "THis" to --This--
Column 4, lines 50 - 51 after "end," delete --an extension 12 which bears at the free end thereof,--

Column 6, line 13, change "hold" to --hole--
Column 6, line 41, change "positioned" to --positions--

Column 8, line 46, change "second occurrence of "18" to --19--
Column 8, line 46, change "pins" to --pin--
Column 8, line 53, change "bu" to --but--
Column 9, line 66, change "hexli-" to --helix- --
Column 10, line 36, change "ispushed" to --is pushed--
Column 11, line 3, after "lever" insert --,--
Column 12, line 38, change "framing" to --forming--

Signed and Sealed this

*Seventh* Day of *July 1981*

[SEAL]

*Attest:*

RENE D. TEGTMEYER

*Attesting Officer* *Acting Commissioner of Patents and Trademarks*